US009256149B2

(12) United States Patent
Matsushima et al.

(10) Patent No.: US 9,256,149 B2
(45) Date of Patent: Feb. 9, 2016

(54) TONER FOR ELECTROSTATIC IMAGE DEVELOPMENT

(71) Applicant: Konica Minolta, Inc., Tokyo (JP)

(72) Inventors: Kaori Matsushima, Tokyo (JP); Masahiro Matsuoka, Tokyo (JP); Aya Shirai, Tokyo (JP); Takaki Kawamura, Tokyo (JP); Taiki Amemiya, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/299,621

(22) Filed: Jun. 9, 2014

(65) Prior Publication Data

US 2014/0377699 A1 Dec. 25, 2014

(30) Foreign Application Priority Data

Jun. 19, 2013 (JP) ..... 2013-128464

(51) Int. Cl.

| | |
|---|---|
| ***G03G 9/097*** | (2006.01) |
| ***G03G 9/087*** | (2006.01) |
| ***G03G 9/08*** | (2006.01) |
| ***G03G 9/093*** | (2006.01) |

(52) U.S. Cl.

CPC ..... *G03G 9/08755* (2013.01); *G03G 9/0825* (2013.01); *G03G 9/08711* (2013.01); *G03G 9/08795* (2013.01); *G03G 9/08797* (2013.01); *G03G 9/09328* (2013.01); *G03G 9/09364* (2013.01); *G03G 9/09392* (2013.01)

(58) Field of Classification Search

CPC ..... G03G 9/08755; G03G 9/0825; G03G 9/07811; G03G 9/08795; G03G 9/08797; G03G 9/09328; G03G 9/09364; G03G 9/09392

See application file for complete search history.

(56) References Cited

U.S. PATENT DOCUMENTS

| | | | | |
|---|---|---|---|---|
| 2003/0039910 | A1* | 2/2003 | Shirai et al. | 430/109.4 |
| 2013/0130166 | A1* | 5/2013 | Matsuoka et al. | 430/109.2 |

FOREIGN PATENT DOCUMENTS

| | | | |
|---|---|---|---|
| JP | 09-258483 | | 10/1997 |
| JP | 2001-142249 | | 5/2001 |
| JP | 2001-222138 | A | 8/2001 |
| JP | 2006-171364 | * | 6/2006 |
| JP | 2010-210862 | | 9/2009 |
| JP | 2011-170229 | A | 9/2011 |
| JP | 2012-88353 | A | 5/2012 |

OTHER PUBLICATIONS

Translation of JP 2006-171364 published Jun. 2006.*

(Continued)

*Primary Examiner* — Peter Vajda
(74) *Attorney, Agent, or Firm* — Lucas & Mercanti, LLP

(57) ABSTRACT

Provided is a toner for electrostatic image development having low-temperature fixability and providing stability of glossiness for various types of paper. The toner for electrostatic image development includes toner particles having a domain-matrix structure. In the domain-matrix structure, a domain phase including a crystalline polyester resin having a melting point of 40 to 90° C. and a domain phase including a vinyl resin B having a weight average molecular weight of 250,000 to 400,000 are dispersed in a matrix phase including a vinyl resin A having a weight average molecular weight of 10,000 to 50,000.

12 Claims, 2 Drawing Sheets

(56) References Cited

OTHER PUBLICATIONS

Office Action dated May 26, 2015 from the corresponding Japanese patent application No. 2013-128464.

English translation of Office Action dated May 26, 2015 from the corresponding Japanese patent application No. 2013-128464.

* cited by examiner

TONER FOR ELECTROSTATIC IMAGE DEVELOPMENT

CROSS REFERENCE TO RELATED APPLICATION

This Application claims the priority of Japanese Patent Application No. 2013-128464 filed on Jun. 19, 2013, which is incorporated by reference herein.

TECHNICAL FIELD

The present invention relates to a toner for electrostatic image development that is used in image formation of an electrophotographic system.

BACKGROUND ART

Recently, to achieve higher energy saving in image forming apparatuses of an electrophotographic system, there is a need for a toner for electrostatic image development (hereinafter may be referred to simply as a "toner") that is heat-fixable at lower temperature.

To address the need for low-temperature fixability, Patent Literature 1, for example, discloses a toner containing a crystalline polyester resin as a fixing aid.

Although such a toner has good low-temperature fixability because of the sharp melting properties of the crystalline polyester resin during heat fixation, the toner has a problem in that its viscosity decreases abruptly during melting, so that the glossiness of the image becomes excessively high, causing glare.

In view of the above, Patent Literature 2, for example, proposes a toner including an amorphous portion having urethane bonds that suppresses the excessive reduction in viscosity of the crystalline polyester resin in a high-temperature state to thereby achieve high glossiness over a wide temperature range.

However, such a toner has a problem in that, although sufficient glossiness is obtained when the toner is used for printing on high-gloss paper such as coated paper, unevenness in gloss occurs when the toner is used for printing on low-gloss paper such as plain paper, so that stability of glossiness cannot be ensured for various types of paper.

For example, Patent Literature 3 proposes a toner in which the type of resin used is not a polyester resin and which includes a combination of a styrene acrylic resin composed of a styrene-based monomer and a (meth)acrylate-based monomer and a high-molecular weight styrene acrylic resin composed of specific acid monomers. In such a toner, the high-molecular weight styrene acrylic resin melts when the toner is in a high-temperature state. The elastic movement of the resins caused by a small temperature change is thereby suppressed, so that unevenness in gloss on paper sheets can be suppressed during continuous printing.

There is a description that, with such a toner, glossiness can be stabilized against temperature. However, the stability of glossiness is not ensured for various types of paper.

CITATION LIST

Patent Literature

Patent Literature 1: Japanese Patent Application Laid-Open No. 2001-222138

Patent Literature 2: Japanese Patent Application Laid-Open No. 2012-88353

Patent Literature 3: Japanese Patent Application Laid-Open No. 2011-170229

SUMMARY OF INVENTION

Technical Problem

The present invention has been made on the basis of the foregoing circumstances and has as its object the provision of a toner for electrostatic image development that has low-temperature fixability and provides stability of glossiness for various types of paper.

Solution to Problem

To achieve at least one of the above mentioned objects, a toner for electrostatic image development reflecting one aspect of the present invention is a toner for electrostatic image development comprising toner particles, wherein the toner particles have a domain-matrix structure in which a domain phase comprising a crystalline polyester resin having a melting point of 40 to 90° C. and a domain phase comprising a vinyl resin B having a weight average molecular weight of 250,000 to 400,000 are dispersed in a matrix phase comprising a vinyl resin A having a weight average molecular weight of 10,000 to 50,000.

In the above mentioned toner for electrostatic image development, a carboxy group concentration $\alpha$ in the vinyl resin A and a carboxy group concentration $\beta$ in the vinyl resin B may preferably satisfy the relation (1): $\beta-\alpha\geq0.5$, and the carboxy group concentration $\beta$ in the vinyl resin B may preferably be 0.7 to 1.5 mmol/g.

In the above mentioned toner for electrostatic image development, the carboxy group concentration $\beta$ in the vinyl resin B may preferably be 1.0 to 1.4 mmol/g.

In the above mentioned toner for electrostatic image development, the carboxy group concentration $\alpha$ in the vinyl resin A may preferably be 0.2 to 1.0 mmol/g.

In the above mentioned toner for electrostatic image development, an ester group concentration in the crystalline polyester resin may preferably be 0.1 to 7.0 mmol/g, more preferably 0.4 to 0.7 mmol/g.

In the above mentioned toner for electrostatic image development, the content of the vinyl resin B in the resins constituting the toner particles may preferably be 2 to 20% by mass.

In the above mentioned toner for electrostatic image development, a content of the crystalline polyester resin in the resins constituting the toner particles may preferably be 5 to 30% by mass.

In the above mentioned toner for electrostatic image development, the melting point of the crystalline polyester resin may preferably be 55 to 85° C. In the above mentioned toner for electrostatic image development, a weight average molecular weight (Mw) and a number average molecular weight (Mn) of the crystalline polyester resin measured by gel permeation chromatography (GPC) may preferably be 2,000 to 30,000, and 2,000 to 25,000, respectively.

In the above mentioned toner for electrostatic image development, the toner particle may preferably have a core particle and a shell layer coating the surface of the core particle to form a core-shell structure, the core particle may preferably have the domain-matrix structure, and the shell layer may preferably comprise an amorphous resin.

In the above mentioned toner for electrostatic image development, in the toner particles having the domain-matrix structure, an average diameter of the domain phase formed of the crystalline polyester resin may preferably be 50 to 2,000 nm, and an average diameter of the domain phase formed of the vinyl resin B may preferably be 50 to 1,000 nm.

Advantageous Effects of Invention

The above mentioned toner for electrostatic image development includes toner particles having a domain-matrix structure in which a crystalline polyester resin having a melting point within a specific range and a vinyl resin B having a weight average molecular weight within a specific range form respective domain phases and are dispersed in a matrix phase composed of a vinyl resin A having a weight average molecular weight within a specific range. Therefore, low-temperature fixability is obtained, and stability of glossiness can be obtained for various types of paper.

DESCRIPTION OF EMBODIMENTS

The present invention will next be described in detail.

Toner:

The toner of the present invention includes toner particles containing at least a binder resin, and the toner particles may contain additional toner components such as a colorant, a magnetic powder, a parting agent and a charge control agent as needed. In addition, external additives such as a flowability improver and a cleaning aid may be added to the toner particles.

The toner particles according to the toner of the present invention have a domain-matrix structure in which domain phases are dispersed in a matrix phase. In the toner of the present invention, the domain phases are formed at least of two types of resins, i.e., a crystalline polyester resin and a vinyl resin B.

Figure 1:
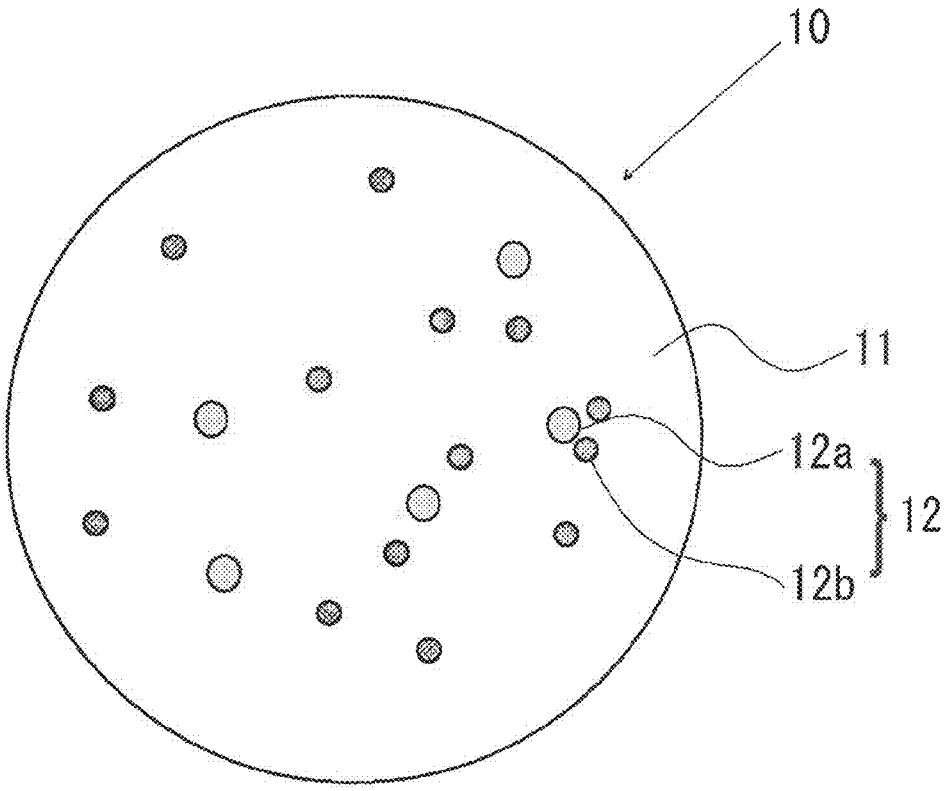
FIG. 1 is a diagram illustrating an example of a cross section of a particle of a toner for electrostatic image development according to the present invention.

More specifically, as shown in FIG. 1, each toner particle 10 has a structure in which a first domain phase 12*a* formed of the crystalline polyester resin and a second domain phase 12*b* formed of the vinyl resin B are independently dispersed in a matrix phase 11 formed of a vinyl resin A.

The domain-matrix structure is a structure in which the domain phases having closed boundaries (boundaries between phases) are present in the continuous matrix phase.

Such a structure can be observed in cross-sectioned toner particles stained with ruthenium (VIII) oxide or osmium (VIII) oxide under a transmission electron microscope (TEM) using a measurement method known per se in the art. When an ultramicrotome is used to cut a slice, the thickness of the slice is set to 100 nm.

In the toner particles 10 in the toner of the present invention, the average diameter of the first domain phase 12*a* formed of the crystalline polyester resin is preferably 50 to 2,000 nm, more preferably 100 to 1,000 nm.

The average diameter of the second domain phase 12*b* formed of the vinyl resin B is preferably 50 to 1,000 nm, more preferably 100 to 500 nm.

The average diameter of each domain phase 12 is a value obtained by visually observing cross-sectional images of toner particles in the results of measurement by the transmission electron microscope (TEM) described above and averaging the major axes of 100 pieces of the domain phase.

In the toner of the present invention, the vinyl resin A used as a main resin contains the crystalline polyester resin, and this basically provides low-temperature fixability. In addition, since the high-molecular weight vinyl resin B is contained as a domain phase, i.e., as a phase not compatible with the vinyl resin A, the following effect is obtained. During heat fixation, the vinyl resin A serving as the main resin and the crystalline polyester resin rapidly melt in a low-temperature state (for example, up to about 150° C.), and fixation on an image supporting medium is facilitated. In this case, it may be considered that, since the vinyl resin A and the crystalline polyester resin melt together, the desired glossiness is achieved. In a high-temperature state (for example, about 150° C. or higher), the vinyl resin B starts melting and dissolves in the vinyl resin A serving as the main resin. The high-molecular weight vinyl resin B dissolved in the vinyl resin A can mitigate the reduction in viscosity of the vinyl resin A, so that an excessive increase in glossiness can be prevented. Therefore, stability of glossiness can be achieved for various types of paper.

Binder Resin:

The binder resin constituting the toner particles according to the present invention comprises the vinyl resin A forming the matrix phase, and the crystalline polyester resin and the vinyl resin B that form the domain phases and may contain other resins.

Vinyl Resin A:

The vinyl resin A constituting the matrix phase is an amorphous resin formed using a monomer having a vinyl group (hereinafter may be referred to as a "vinyl monomer").

As examples of the vinyl resin A, may be mentioned a styrene resin, an acrylic resin, and a styrene-acrylic copolymer resin.

The following monomers etc. can be used as the vinyl monomer. Such vinyl monomers may be used either singly or in any combination thereof.

(1) Styrene-Based Monomers

Styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, p-n-dodecylstyrene, derivatives thereof, etc.

(2) (Meth)Acrylate-Based Monomers

Methyl(meth)acrylate, ethyl(meth)acrylate, n-butyl(meth)acrylate, isopropyl(meth)acrylate, isobutyl(meth)acrylate, t-butyl(meth)acrylate, n-octyl(meth)acrylate, 2-ethylhexyl(meth)acrylate, stearyl(meth)acrylate, lauryl(meth)acrylate, phenyl(meth)acrylate, diethylaminoethyl(meth)acrylate, dimethylaminoethyl(meth)acrylate, derivatives thereof, etc.

(3) Vinyl Esters

Vinyl propionate, vinyl acetate, vinyl benzoate, etc.

(4) Vinyl Ethers

Vinyl methyl ether, vinyl ethyl ether, etc.

(5) Vinyl Ketones

Vinyl methyl ketone, vinyl ethyl ketone, vinyl hexyl ketone, etc.

(6) N-Vinyl Compounds

N-vinylcarbazole, N-vinylindole, N-vinylpyrrolidone, etc.

(7) Others

Vinyl compounds such as vinylnaphthalene and vinylpyridine, derivatives of acrylic acid and methacrylic acid such as acrylonitrile, methacrylonitrile and acrylamide, etc.

The vinyl monomer used is preferably a monomer having an ionic leaving group such as a carboxy group, a sulfonate group or a phosphate group. Specific examples include the following monomers.

As examples of the monomer having a carboxy group, may be mentioned acrylic acid, methacrylic acid, maleic acid, itaconic acid, cinnamic acid, fumaric acid, maleic acid monoalkyl esters and itaconic acid monoalkyl esters. As examples of the monomer having a sulfonate group, may be mentioned styrenesulfonic acid, allyl sulfosuccinic acid and 2-acrylamide-2-methylpropane sulfonic acid. As examples of the monomer having a phosphate group, may be mentioned acid phosphoxyethyl methacrylate.

In the present invention, when the monomer having an ionic leaving group is used as the vinyl monomer, the ratio of the monomer having an ionic leaving group to all the vinyl monomers is preferably 2 to 10% by mass. If the ratio of the monomer having an ionic leaving group is excessively high, the amount of water adsorbed on the surface of the toner particles becomes large. In this case, toner blisters may occur, and the environmental difference in the amount of charge may increase.

In addition, a polyfunctional vinyl compound may be used as a vinyl monomer to allow the vinyl resin to have a cross-linked structure. As examples of the polyfunctional vinyl, may be mentioned divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate and neopentyl glycol diacrylate.

Preferably, the carboxy group concentration $\alpha$ in the vinyl resin A and the carboxy group concentration $\beta$ in the vinyl resin B described later satisfy the relation (1): $\beta-\alpha\geq0.5$. More specifically, the carboxy group concentration $\alpha$ is preferably 0.2 to 1.0 mmol/g, more preferably 0.5 to 0.8 mmol/g.

When the carboxy group concentration $\alpha$ in the vinyl resin A falls within the above range, the vinyl resin A is not compatible with the vinyl resin B before heat fixation and is compatible with the vinyl resin B during heat fixation (in a high-temperature state), in relation to the carboxy group concentration in the vinyl resin B. Therefore, during heat fixation, the vinyl resin B starts melting in the high-temperature state and dissolves in the vinyl resin A. This can mitigate the reduction in viscosity of the vinyl resin A, and an excessive increase in glossiness can be prevented in a reliable manner. In relation to the ester group concentration in the crystalline polyester resin, the vinyl resin A and the crystalline polyester resin are not compatible with each other, and the crystalline polyester resin does not cause plasticization of the vinyl resin A to proceed before heat fixation (e.g., during storage of the toner), so that heat-resistant storage stability can be ensured.

If the relation (1) does not hold ($\beta-\alpha<0.5$), the vinyl resin A and the vinyl resin B are compatible with each other before heat fixation, and this may cause a reduction in glossiness.

If the carboxy group concentration $\alpha$ in the vinyl resin A is excessively high, the hygroscopicity of the toner becomes high, and environmental variations in triboelectrification of the toner become high, so that image stability may deteriorate. If the carboxy group concentration $\alpha$ in the vinyl resin A is excessively low, salt cross-links through carboxy groups and metal ions become insufficient. In this case, the strength of the resin at room temperature becomes low, and the toner may be more likely to aggregate during long-term storage and transportation.

The carboxy group concentration is the ratio of carboxy groups in a vinyl resin and represents the affinity for water. The higher the value of the carboxy group concentration is, the higher the affinity for water is.

In the present invention, the carboxy group concentration is a value computed using the following formula (1):

Formula (1): carboxy group concentration=[the number of moles of carboxy groups/the sum of (the molecular weight of each monomer forming the vinyl resin×its molar fraction)]×1000.

The carboxy group concentration in the vinyl resin can be controlled by changing the introduction ratio of the monomer having a carboxy group.

The glass transition point (Tg) of the vinyl resin A is preferably 20 to 70° C., more preferably 25 to 60° C.

When the glass transition point of the vinyl resin A falls within the above range, both sufficient low-temperature fixability and heat-resistant storage stability are achieved simultaneously in a reliable manner.

If the glass transition point of the vinyl resin A is excessively low, the heat resistance (thermal strength) of the toner deteriorates. In this case, sufficient heat-resistant storage stability and hot offset resistance may not be obtained. If the glass transition point of the vinyl resin A is excessively high, sufficient low-temperature fixability may not be obtained.

The glass transition point (Tg) of a vinyl resin is a value measured using "Diamond DSC" (manufactured by PerkinElmer Co., Ltd.).

The procedure of the measurement will next be described. First, 3.0 mg of a measurement sample (the vinyl resin) is sealed in an aluminum-made pan, and the pan is placed in a holder. An empty aluminum-made pan is used as a reference. A Heat-cool-Heat cycle is performed in the measurement temperature range of 0° C. to 200° C. while the temperature is controlled under the measurement conditions of a temperature increase rate of 10° C./min and a temperature decrease rate of 10° C./min. Analysis is performed using data in the 2nd heating, and the intersection of the extension of a base line before the rising edge of a first endothermic peak and a tangential line representing the maximum inclination between the rising edge of the first endothermic peak and the top of the peak is used as the glass transition point.

The softening point (Tsp) of the vinyl resin A is preferably 80 to 130° C., more preferably 90 to 110° C.

In the present invention, the softening point (Tsp) of a vinyl resin is a value measured as follows.

First, 1.1 g of a measurement sample (the vinyl resin) is placed in a petri dish in an environment of 20±1° C. and 50±5% RH and then is leveled off. After left to stand for 12 hours or longer, the measurement sample is pressurized using a press "SSP-10A" (manufactured by Shimadzu Corporation) at a pressure of 3,820 kg/cm$^2$ for 30 seconds to produce a cylindrical molded sample having a diameter of 1 cm. Then the molded sample is placed in a flow tester "CFT-500D" (manufactured by Shimadzu Corporation) in an environment of 24±5° C. and 50±20% RH. Under the conditions of a load of 196 N (20 kgf), a start temperature of 60° C., a preheating time of 300 seconds and a temperature increase rate of 6° C./min, the molded sample is extruded from the hole (1 mm diameter×1 mm) of a cylindrical die using a piston having a diameter of 1 cm after completion of preheating. An offset temperature $T_{offset}$ measured by a melting point measurement method using a temperature rise method at an offset value setting of 5 mm is used as the softening point.

The molecular weight, i.e., the weight average molecular weight (Mw), of the vinyl resin A measured by gel permeation chromatography (GPC) is preferably 10,000 to 50,000, more preferably 20,000 to 40,000.

When the weight average molecular weight of the vinyl resin A falls within the above range, low-temperature fixability can be ensured.

If the weight average molecular weight of the vinyl resin A is excessively high, sufficient low-temperature fixability may not be obtained. If the weight average molecular weight of the vinyl resin A is excessively low, the heat resistance (thermal strength) of the toner deteriorates. In this case, sufficient heat-resistant storage stability and hot offset resistance may not be obtained.

The molecular weight of a vinyl resin measured by gel permeation chromatography (GPC) is a value measured as follows.

The molecular weight is measured using an apparatus "HLC-8120GPC" (manufactured by TOSOH Corporation) and a column "TSKguardcolumn+TSKgel SuperHZM-M (three in series)" (manufactured by TOSOH Corporation) in the flow of tetrahydrofuran (THF) used as a carrier solvent at a flow rate of 0.2 mL/min while the temperature of the column is held at 40° C. The measurement sample (the vinyl resin) is dissolved in tetrahydrofuran at a concentration of 1 mg/mL using an ultrasonic disperser. In this case, the dissolving treatment is performed at room temperature for 5 minutes. Next, the obtained solution is treated through a membrane filter having a pore size of 0.2 μm to obtain a sample solution, and 10 μL of the sample solution together with the above-described carrier solvent is injected into the apparatus. Detection is performed using a refractive index detector (RI detector), and the molecular weight distribution of the measurement sample is computed using a calibration curve determined using monodispersed polystyrene standard particles. Ten different types of polystyrene were used for the determination of the calibration curve.

The content of the vinyl resin A in the resins (the binder resin) constituting the toner particles is preferably 60 to 95% by mass.

When the content of the vinyl resin A falls within the above range, both low-temperature fixability and heat-resistant storage stability are obtained in a reliable manner.

Crystalline Polyester Resin:

The crystalline polyester resin constituting the domain phase is any known polyester resin obtained by a polycondensation reaction of a divalent or higher carboxylic acid (polyvalent carboxylic acid) and a dihydric or higher alcohol (a polyhydric alcohol) and showing a clear endothermic peak rather than a stepwise endothermic change in differential scanning calorimetry (DSC). Specifically, the clear endothermic peak is an endothermic peak with a half-value width of 15° C. or less in differential scanning calorimetry (DSC) when the measurement is performed at a temperature increase rate of 10° C./min.

The polyvalent carboxylic acid is a compound having two or more carboxy groups in its molecule.

As specific examples of the polyvalent carboxylic acid, may be mentioned: saturated aliphatic dicarboxylic acids such as oxalic acid, malonic acid, succinic acid, adipic acid, sebacic acid, azelaic acid and n-dodecylsuccinic acid; alicyclic dicarboxylic acids such as cyclohexane dicarboxylic acid; aromatic dicarboxylic acids such as phthalic acid, isophthalic acid and terephthalic acid; trivalent or higher polyvalent carboxylic acids such as trimellitic acid and pyromellitic acid; and anhydrides and C1 to C3 alkyl esters of these carboxylic acid compounds.

These may be used either singly or in any combination thereof.

The polyhydric alcohol is a compound having two or more hydroxy groups in its molecule.

As specific examples of the polyhydric alcohol, may be mentioned: aliphatic diols such as 1,2-propanediol, 1,3-propanediol, 1,4-butanediol, 1,5-pentanediol, 1,6-hexanediol, 1,7-heptanediol, 1,8-octanediol, neopentyl glycol and 1,4-butenediol; and trihydric or higher alcohols such as glycerin, pentaerythritol, trimethylolpropane and sorbitol.

These may be used either singly or in any combination thereof.

The ester group concentration γ in the crystalline polyester resin is preferably 0.1 to 7.0 mmol/g, more preferably 0.4 to 0.7 mmol/g.

When the ester group concentration in the crystalline polyester resin falls within the above range, the crystalline polyester resin is not compatible with the vinyl resin A and the vinyl resin B before heat fixation, in relation to the carboxy group concentrations in the vinyl resin A and the vinyl resin B. Therefore, the crystalline polyester resin does not cause plasticization of the vinyl resin A to proceed before heat fixation, so that heat-resistant storage stability can be ensured.

If the ester group concentration in the crystalline polyester resin is excessively high, the crystalline polyester resin dissolves in the vinyl resin A before heat fixation, causing plasticization of the vinyl resin A. In this case, heat-resistant storage stability may not be obtained. If the ester group concentration in the crystalline polyester resin does not dissolve sufficiently in the vinyl resin A during heat fixation, so that low-temperature fixability may not be achieved.

The ester group concentration used herein is the ratio of ester groups (ester bonds) in the crystalline polyester resin and represents the degree of affinity for water. The higher the value of the ester group concentration is, the higher the affinity for water is.

In the present invention, the ester group concentration is a value computed using the following formula (2):

Formula (2): ester group concentration=[the average of the numbers of moles of portions capable of forming ester groups and included in the polyvalent carboxyl acid and the polyhydric alcohol forming the crystalline polyester resin/((the sum total of the molecular weight of the polyvalent carboxyl acid and the molecular weight of the polyhydric alcohol)−(the molecular weight of water separated by dehydration polycondensation×the number of moles of ester groups))]×1000

The ester group concentration in the crystalline polyester resin can be controlled by changing the types of the monomers.

An example of the computation of the ester group concentration in the crystalline polyester resin is shown below.

A crystalline polyester resin obtained from a polyvalent carboxyl acid represented by the following formula (a) and a polyhydric alcohol represented by the following formula (b) is represented by the following formula (c).

$$HOOC—R^1—COOH \quad \text{Formula (a):}$$

$$HO—R^2—OH \quad \text{Formula (b):}$$

$$—(—OCO—R^1—COO—R^2—)_n— \quad \text{Formula (c):}$$

"The average of the numbers of moles of portions capable of forming ester groups and included in the polyvalent carboxyl acid and the polyhydric alcohol forming the crystalline polyester resin" is the average of the number of moles of carboxy groups in the polyvalent carboxyl acid forming the crystalline polyester resin and the number of moles of hydroxyl groups in the polyhydric alcohol forming the crystalline polyester resin. More specifically, this value is the average of the number of moles of carboxy groups in the polyvalent carboxyl acid of formula (a), i.e., "2," and the number of moles of hydroxy groups in the polyhydric alcohol of formula (b), i.e., "2," and is therefore "2."

Let the molecular weight of the polyvalent carboxyl acid of the formula (a) be m1, the molecular weight of the polyhydric alcohol of the formula (b) be m2, and the molecular weight of the crystalline polyester resin of the formula (c) be m3. Then "(the sum total of the molecular weight of the polyvalent carboxyl acid and the molecular weight of the polyhydric alcohol)−(the molecular weight of water separated by dehydration polycondensation×the number of moles of ester groups)" is (m1+m2)−(18×the average number of moles of ester groups, i.e., "2") and is therefore equal to the molecular weight "m3" of the crystalline polyester resin of the formula (c).

Accordingly, the ester group concentration in the crystalline polyester resin represented by the formula (c) is "2/m3."

When two or more types of polyvalent carboxyl acids are used, the average of the numbers of moles of carboxy groups in the polyvalent carboxyl acids and the average of their molecular weights are used. When two or more types of polyhydric alcohols are used, the average of the numbers of moles of hydroxyl groups in the polyhydric alcohols and the average of their molecular weights are used.

The melting point of the crystalline polyester resin is preferably 40 to 90° C., more preferably 55 to 85° C. The melting point of the crystalline polyester resin is lower than the softening point of the vinyl resin B described later.

When the melting point of the crystalline polyester resin falls within the above range, sufficient low-temperature fixability is obtained. In addition, in a low-temperature state during heat fixation, the crystalline polyester resin and the vinyl resin A rapidly melt to facilitate fixation onto an image supporting medium, and sufficient glossiness can be obtained in this case.

If the melting point of the crystalline polyester resin is excessively low, the heat resistance (thermal strength) of the toner deteriorates. In this case, sufficient heat-resistant storage stability and hot offset resistance may not be obtained. If the melting point of the crystalline polyester resin is excessively high or is equal to or higher than the softening point of the vinyl resin B, sufficient low-temperature fixability may not be obtained. In addition, during heat fixation, the crystalline polyester resin may not melt rapidly in the low-temperature state, and the vinyl resin B may start melting before the crystalline polyester resin starts melting. In this case, fixation onto the image supporting medium cannot be facilitated. In addition, the viscosity of the vinyl resin A increases abruptly, so that glossiness may decrease excessively.

The melting point of the crystalline polyester resin can be controlled by changing the resin composition.

The melting point of the crystalline polyester resin is a value measured as follows.

The melting point of the crystalline polyester is the temperature of the peak top of an endothermic peak and determined by DSC measurement in differential scanning calorimetry using "Diamond DSC" (manufactured by PerkinElmer Co., Ltd.).

More specifically, 1.0 mg of a measurement sample (the crystalline polyester resin) is sealed in an aluminum-made pan (KITNO. B0143013), and the pan is placed in a sample holder of the "Diamond DSC." A heating-cooling-heating cycle is performed in the measurement temperature range of 0 to 200° C. while the temperature is controlled under the measurement conditions of a temperature increase rate of 10° C./min and a temperature decrease rate of 10° C./min. Analysis is performed using data in the second heating.

The molecular weight, i.e., the weight average molecular weight (Mw), of the crystalline polyester resin measured by gel permeation chromatography (GPC) is preferably 2,000 to 30,000, and its number average molecular weight (Mn) is preferably 2,000 to 25,000.

The molecular weights of the crystalline polyester resin measured by gel permeation chromatography (GPC) are measured in the same manner as described above except that the crystalline polyester resin is used as the measurement sample.

The content of the crystalline polyester resin in the binder resin is preferably 5 to 30% by mass, more preferably 10 to 25% by mass.

When the content of the crystalline polyester resin falls within the above range, low-temperature fixability can be reliably obtained.

If the content of the crystalline polyester resin is excessively low, a sufficient low-temperature fixation effect may not be obtained. If the content of the crystalline polyester resin is excessively high, the reduction in viscosity becomes significant in a high-temperature state during heat fixation, so that hot offset resistance may deteriorate.

Vinyl Resin B:

The vinyl resin B forming the domain phase is an amorphous resin formed using a vinyl monomer.

As examples of the vinyl monomer, may be mentioned the vinyl monomers exemplified for vinyl resin A. To allow the vinyl resin B to have a carboxy group concentration within the range described later, a monomer having a carboxy group must be used as the vinyl monomer, and it is particularly preferable to use itaconic acid having a plurality of carboxy groups. When itaconic acid is used as the vinyl monomer for forming the vinyl resin B and acrylic acid is used as the vinyl monomer for forming the vinyl resin A, the vinyl resin A and the vinyl resin B smoothly dissolve in each other in a high-temperature state during heat fixation.

The carboxy group concentration β in the vinyl resin B is preferably 0.7 to 1.5 mmol/g, more preferably 1.0 to 1.4 mmol/g.

When the carboxy group concentration β in the vinyl resin B falls within the above range, the vinyl resin B is not compatible with the vinyl resin A before heat fixation and is compatible with the vinyl resin A during heat fixation (in a high-temperature state), in relation to the carboxy group concentration in the vinyl resin A. Therefore, during heat fixation, the vinyl resin B starts melting in the high-temperature state and dissolves in the vinyl resin A. In this case, the reduction in viscosity of the vinyl resin A can be mitigated, and an excessive increase in glossiness can be prevented in a reliable manner.

If the carboxy group concentration β in the vinyl resin B is excessively high, the vinyl resin B does not sufficiently dissolve in the vinyl resin A during heat fixation (in the high-temperature state), so that the reduction in viscosity of the vinyl resin A may not by suppressed. If the carboxy group concentration β in the vinyl resin B is excessively low, the vinyl resin B dissolves in the vinyl resin A before heat fixation, so that sufficient low-temperature fixability may not be ensured.

Preferably, the softening point (Tsp) of the vinyl resin B is higher than the melting point of the crystalline polyester resin and is specifically 100 to 190° C.

When the softening point of the vinyl resin B falls within the above range, the vinyl resin B does not start melting together with the vinyl resin A and the crystalline polyester resin in a low-temperature state during heat fixation but starts melting in a high-temperature state, and then the vinyl resin B dissolve in the vinyl resin A. The high-molecular weight vinyl resin B dissolved in the vinyl resin A can mitigate the reduction in viscosity of the vinyl resin A, so that an excessive increase in glossiness can be prevented.

If the softening point of the vinyl resin B is equal to or lower than the melting point of the crystalline polyester resin, the vinyl resin B may start melting in a low-temperature state during heat fixation before the crystalline polyester resin starts melting. This causes the viscosity of the vinyl resin A to increase abruptly, so that the glossiness may decrease excessively.

If the softening point of the vinyl resin B is excessively high, satisfactory low-temperature fixability may not be obtained. If the softening point of the vinyl resin B is excessively low or is equal to or lower than the melting point of the crystalline polyester resin, the vinyl resin B may start melting in a low-temperature state during heat fixation before the crystalline polyester resin starts melting. This causes the viscosity of the vinyl resin A to increase abruptly, so that the glossiness may decrease excessively.

The softening point of the vinyl resin B can be controlled by changing the types and amounts of a chain transfer agent and a polymerization initiator.

The molecular weight, i.e., the weight average molecular weight (Mw), of the vinyl resin B measured by gel permeation chromatography (GPC) is preferably 250,000 to 400,000, more preferably 260,000 to 320,000.

When the weight average molecular weight of the vinyl resin B falls within the above range, the vinyl resin B starts melting in a high-temperature state during heat fixation and dissolves in the vinyl resin A, so that the reduction in viscosity of the vinyl resin A can be mitigated. In this case, an excessive increase in glossiness can be prevented in a reliable manner.

If the weight average molecular weight of the vinyl resin B is excessively high, the viscosity of the vinyl resin A rather increases when the vinyl, resin B dissolves in the vinyl resin A in the high-temperature state during heat fixation, and this may cause a reduction in glossiness. If the weight average molecular weight of the vinyl resin B is excessively low, the reduction in viscosity of the vinyl resin A cannot be sufficiently mitigated even when the vinyl resin B dissolves in the vinyl resin A in the high-temperature state during heat fixation, so that an excessive increase in glossiness may not be prevented.

The weight average molecular weight of the vinyl resin B can be controlled by changing the amounts added of the chain transfer agent and the polymerization initiator.

The content of the vinyl resin B in the binder resin is preferably 2 to 20% by mass.

When the content of the vinyl resin B falls within the above range, the glossiness can be adjusted within an appropriate range.

Figure 2:
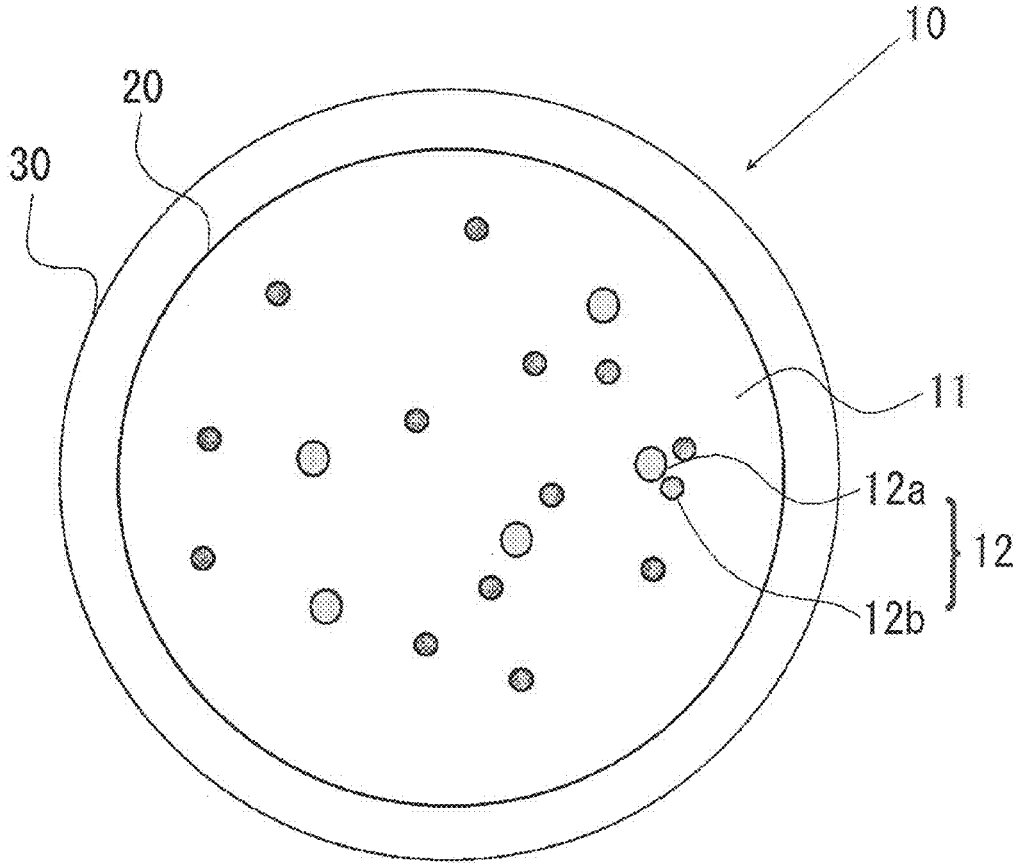
FIG. 2 is a diagram illustrating another example of a cross section of a particle of a toner for electrostatic image development according to the present invention.

Preferably, in the toner of the present invention, the toner particles have a core-shell structure in which the surface of core particles is coated with a shell layer. More specifically, it is preferable that, in each toner particle 10, the surface of the core particle 20 having the domain-matrix structure is coated with the shell layer 30, as shown in FIG. 2.

The shell layer is not limited to that fully covering the core particle, and part of the surface of the core particle may be exposed.

When the toner particles have the core-shell structure, more reliable heat-resistant storage stability can be obtained.

No particular limitation is imposed on the resin constituting the shell layer. For example, the same resin as the vinyl resin A forming the matrix phase in the domain-matrix structure or an amorphous resin having a higher glass transition point is preferred.

The thickness of the shell layer is preferably 0.1 to 1 μm, more preferably 0.3 to 0.7 μm.

In the present invention, the thickness of the shell layer is a value measured using the transmission electron microscope (TEM) described above.

The content of the resin forming the shell layer in the binder resin is preferably 2 to 10% by mass.

Colorant:

In the toner of the present invention, when the toner particles are configured to contain a colorant, the colorant may be contained in any of the matrix phase and the domain phases. When the toner particles have the core-shell structure, the colorant may be contained in any of the core particle and the shell layer.

Any of various colorants such as carbon black, dyes and pigments can be used as the colorant.

As examples of the carbon black, may be mentioned channel black, furnace black, acetylene black, thermal black and lamp black. As examples of black iron oxide, may be mentioned magnetite, hematite and iron titanium trioxide.

As examples of the dye, may be mentioned C.I. Solvent Red: 1, 49, 52, 58, 63, 111 and 122, C.I. Solvent Yellow: 1.9, 44, 77, 79, 81, 82, 93, 98, 103, 104, 112 and 162 and C.I. Solvent Blue: 25, 36, 60, 70, 93 and 95.

As examples of the pigment, may be mentioned C.I. Pigment Red: 5, 48:1, 48:3, 53:1, 57:1, 81:4, 122, 139, 144, 149, 150, 166, 177, 178, 222, 238 and 269, C.I. Pigment Orange: 31 and 43, C.I. Pigment Yellow: 14, 17, 74, 93, 94, 138, 155, 156, 158, 180 and 185, C.I. Pigment Green: 7 and C.I. Pigment Blue: 15:3 and 60.

One colorant or a combination of two or more colorants may be used for a color toner.

The content of the colorant in the toner particles is preferably 1 to 10% by mass, more preferably 2 to 10% by mass. If the content of the colorant is excessively small, the toner obtained may not have the desired coloring power. If the content of the colorant is excessively large, the colorant may be separated or adhere to a carrier etc., and this may affect charge property.

Parting Agent:

In the toner of the present invention, when the toner particles are configured to contain a parting agent, the parting agent may be contained in any of the matrix phase and the domain phases. When the toner particles have the core-shell structure, the parting agent may be contained in any of the core particle and the shell layer.

Any of various publicly known waxes may be used as the parting agent.

Any of polyolefin-based waxes such as low-molecular weight polypropylene wax, low-molecular weight polyethylene wax, oxidized-type polypropylene wax and oxidized-type polyethylene wax and ester-based waxes such as behenic acid behenate wax can be particularly preferably used.

As specific examples of the wax, may be mentioned: polyolefin waxes such as polyethylene wax and polypropylene wax; branched chain hydrocarbon waxes such as microcrystalline wax; long chain hydrocarbon-based waxes such as paraffin wax and Sasol wax; dialkyl ketone-based waxes such as distearyl ketone; ester-based waxes such as carnauba wax, montan wax, behenic acid behenate, trimethylolpropane tribehenate, pentaerythritol tetrabehenate, pentaerythritol diacetate dibehenate, glycerin tribehenate, 1,18-octadecanediol distearate, tristearyl trimellitate and distearyl maleate; and amide-based waxes such as ethylenediamine behenylamide and tristearyl trimellitate amide.

Of these, a wax having a low melting point, i.e., a melting point of 40 to 90° C., is preferably used from the viewpoint of releasability during low-temperature fixation.

The content of the parting agent in the toner particles is preferably 3 to 20% by mass, more preferably 5 to 15% by mass. When the content of the parting agent in the toner particles falls within the above range, releasability and fixability can be achieved simultaneously in a reliable manner.

Charge Control Agent:

In the toner of the present invention, when the toner particles are configured to contain a charge control agent, the charge control agent may be contained in any of the matrix phase and the domain phases. When the toner particles have the core-shell structure, the charge control agent may be contained in any of the core particle and the shell layer.

Any of various publicly known compounds may be used as the charge control agent.

The content of the charge control agent in the toner particles is preferably 0.1 to 5% by mass, more preferably 0.3 to 3.0% by mass.

External Additives:

The toner particles in the toner of the present invention can be used as the toner without adding any additive. However, to improve flowability, charge property, cleanability, etc., external additives such as a flowability improver and a cleaning aid may be added to the toner particles.

A combination of various external additives may be used.

The ratio of the total amount of the external additives added is preferably 0.05 to 5 parts by mass, more preferably 0.1 to 3 parts by mass per 100 parts by mass of the toner particles.

Glass Transition Point of Toner:

The toner of the present invention has a glass transition point (Tg) of preferably 25 to 50° C., more preferably 25 to 45° C.

When the glass transition point of the toner of the present invention falls within the above range, sufficient low-temperature fixability and heat-resistant storage stability are obtained simultaneously in a reliable manner. If the glass transition point of the toner is excessively low, the heat resistance (thermal strength) of the toner deteriorates. In this case, sufficient heat-resistant storage stability and hot offset resistance may not be obtained. If the glass transition point of the toner is excessively high, sufficient low-temperature fixability may not be obtained.

The glass transition point of the toner is measured in the same manner as described above except that the toner is used as the measurement sample.

Particle Diameter of Toner:

The average particle diameter, for example, the volume-based median diameter, of the toner of the present invention is preferably 3 to 8 μm, more preferably 5 to 8 μm. The average particle diameter can be controlled by changing the concentration of an aggregating agent used for production of the toner, the amount added of an organic solvent, fusion-bonding time, the chemical composition of the binder resin, etc.

When the volume-based median diameter falls within the above range, a very fine dot image of 1200 dpi can be faithfully reproduced.

The volume-based median diameter of the toner is measured and computed using a measuring device composed of "Multisizer 3" (manufactured by Beckman Coulter, Inc.) and a computer system connected thereto and equipped with data processing software "Software V3.51." More specifically, 0.02 g of a measurement sample (the toner) is added to 20 mL of a surfactant solution (a surfactant solution used for the purpose of dispersing the toner particles and prepared, for example, by diluting a neutral detergent containing a surfactant component ten-fold with pure water) and is left to stand. The obtained solution is subjected to ultrasonic dispersion for 1 minute to prepare a dispersion of the toner. This toner dispersion is added with a pipette to a beaker containing "ISOTON II" (manufactured by Beckman Coulter, Inc.) and held in a sample stand until the concentration displayed in the measuring device reaches 8%. By using the above concentration range, a reproducible measurement value can be obtained. In the measuring device, the number of particles to be counted is set to 25,000, and the diameter of an aperture is set to 100 μm. The range of measurement, a 2 to 60 μm range, is divided into 256 sections, and a frequency value in each section is computed. The particle size when a cumulative volume fraction cumulated from the large-diameter side reaches 50% is used as the volume-based median diameter.

Average Circularity of Toner:

In the toner of the present invention, the average circularity of the toner particles included in the toner is preferably 0.930 to 1.000, more preferably 0.950 to 0.995 from the viewpoint of stability of electrification characteristics and low-temperature fixability.

When the average circularity falls within the above range, individual toner particles are less likely to be broken. Therefore, contamination of a triboelectrifying member is suppressed, so that the charge property of the toner are stabilized. In addition, the quality of a formed image becomes high.

The average circularity of the toner is a value measured using "FPIA-2100" (manufactured by Sysmex Corporation).

More specifically, a measurement sample (the toner) is left to stand in a surfactant-containing aqueous solution and then subjected to ultrasonic dispersion treatment for 1 minute to disperse the toner. Then images of the toner are taken using the "FPIA-2100" (manufactured by Sysmex Corporation) in an HPF (high-power field) measurement mode at an appropriate concentration in which the number of particles detected in the HPF mode is 3,000 to 10,000. The circularity of each of the particles is computed using the following formula (y). The computed circularity values of the toner particles are summed up, and the sum total is divided by the total number of toner particles to compute the average circularity. When the number of particles detected in the HPF mode falls within the above range, reproducibility is obtained.

Formula (*y*): circularity=(the circumferential length of a circle having the same area as the projected area of a particle image)/(the circumferential length of the projected particle image)

Developer:

The toner of the present invention can be used as a magnetic or non-magnetic one-component developer or may be mixed with a carrier and used as a two-component developer. When the toner is used as a two-component developer, the carrier used may be magnetic particles of a publicly known material such as a metal, for example, iron, ferrite or magnetite or an alloy of any of these metals with a metal such as aluminum or lead. Ferrite particles are particularly preferred. The carrier used may be a coated carrier prepared by coating the surface of magnetic particles with a coating agent such as a resin or a dispersion-type carrier prepared by dispersing a fine magnetic powder in a binder resin.

The volume-based median diameter of the carrier is preferably 20 to 100 μm, more preferably 25 to 80 μm. A representative example of the device used to measure the volume-based median diameter of the carrier is a laser diffraction-type particle size distribution measuring device "HELOS" (manufactured by SYMPATEC) equipped with a wet-type disperser.

In the present invention, to examine the carboxy group concentrations in the vinyl resins and the ester group concentration in the crystalline polyester resin, the vinyl resins and the crystalline polyester resin contained in the toner particles must be extracted. More specifically, the resins can be extracted from the toner particles as follows.

First, the toner is dissolved in methyl ethyl ketone (MEK) at room temperature (20° C. or higher and 25° C. or lower). In this case, the resins in amorphous form (the vinyl resins) in the toner particles dissolve in MEK at room temperature. Therefore, the components dissolved in MEK include the resins in amorphous form, and the dissolved resins in amorphous form are obtained from a supernatant separated by centrifugation. The solids after centrifugation are heated at 65° C. for 60 minutes and dissolved in tetrahydrofuran (THF). The resultant solution is filtrated through a glass filter at 60° C., and the crystalline polyester resin is obtained from the filtrate. If the temperature decreases during filtration in the above procedure, the crystalline polyester resin precipitates. Therefore, the procedure is performed while the temperature is maintained.

The carboxy group concentrations in the vinyl resins can be determined by, for example, 12C-NMR (nuclear magnetic resonance) measurement using deuteriochloroform. More specifically, peaks of carbon atoms originating from the monomers are identified, and the types of monomers and the compositional ratio are specified to compute the carboxy group concentrations.

The ester group concentration in the crystalline polyester resin can be determined by hydrolyzing the crystalline polyester resin, performing measurement by P-GC/MS, and specifying the types of acid and alcohol monomers to compute the ester group concentration.

Production Process of Toner;

As examples of the production process of the toner, which is not limited to particular ones, may be mentioned a wet production process, such as an emulsion aggregation process, in which the toner is produced in a water-based medium.

In the production process of the toner of the present invention using the emulsion aggregation process, a water-based dispersion containing fine particles of the binder resin (hereinafter may be referred to as "fine binder resin particles") dispersed in a water-based medium is mixed with a water-based dispersion containing fine particles of the colorant (hereinafter may be referred to as "fine colorant particles"). Then the fine binder resin particles and the fine colorant particles are aggregated and heat-fused to form toner particles, whereby the toner is produced.

One example of the production process of the toner of the present invention will be described specifically.

The production process includes:

(a) a step of preparing a water-based dispersion containing fine particles of the vinyl resin A (hereinafter may be referred to as "fine resin particles A") dispersed in a water-based medium;

(b) a step of preparing a water-based dispersion containing fine colorant particles dispersed in a water-based medium;

(c) a step of preparing a water-based dispersion containing fine particles of the crystalline polyester resin (hereinafter may be referred to as "fine crystalline polyester resin particles") dispersed in a water-based medium;

(d) a step of preparing a water-based dispersion containing fine particles of the vinyl resin B (hereinafter may be referred to as "fine resin particles B") in a water-based medium;

(e) a step of aggregating and fusion-bonding the fine resin particles A, the fine crystalline polyester resin particles, the fine resin particles B and the fine colorant particles in a water-based medium to form toner particles;

(f) a step of aging the toner particles using thermal energy to control their shape;

(g) a step of cooling the dispersion of the toner particles;

(h) a step of separating the toner particles from the water-based medium by filtration to remove a surfactant etc. from the toner particles;

(i) a step of drying the washed toner particles; and (j) an optional step of adding external additives to the dried toner particles.

A "water-based dispersion" used herein is a dispersion containing a dispersoid (fine particles) dispersed in a water-based medium, and the water-based medium is a medium composed mainly of water (50% by mass or more). A component other than water may be an organic solvent soluble in water. As examples of such an organic solvent, may be mentioned methanol, ethanol, isopropanol, butanol, acetone, methyl ethyl ketone and tetrahydrofuran. Of these, alcohol-based organic solvents such as methanol, ethanol, isopropanol and butanol that are organic solvents not dissolving the resins are particularly preferred.

(a) Step of Preparing Water-Based Dispersion of Fine Resin Particles A:

In this step, the water-based dispersion of the fine resin particles A formed of the vinyl resin A is prepared.

The water-based dispersion of the fine resin particles A can be prepared by a miniemulsion polymerization process using the vinyl monomer for obtaining the vinyl resin A. More specifically, for example, the vinyl monomer is added to a water-based medium containing a surfactant, and mechanical energy is applied thereto to form liquid droplets. Then a polymerization reaction is allowed to proceed in the liquid droplets via radicals from a water-soluble radical polymerization initiator. The liquid droplets may contain an oil-soluble polymerization initiator. The water-based dispersion of the fine resin particles formed of the vinyl resin A can thereby be prepared.

The fine resin particles A formed of the vinyl resin A may have a multilayer structure including two or more layers composed of vinyl resins with different compositions. The fine resin particles A having such a structure, for example, a two-layer structure, can be obtained by the following process. A dispersion of resin particles is prepared by emulsion polymerization treatment (first polymerization) known per se in the art, and a polymerization initiator and a vinyl monomer are added to the dispersion. Then the resultant system is subjected to polymerization treatment (second polymerization).

Surfactant:

The surfactant used in this step may be any of various publicly known surfactants such as anionic surfactants, cationic surfactants and nonionic surfactants.

Polymerization Initiator:

The polymerization initiator used in this step may be any of various publicly known polymerization initiators. As specific preferred examples of the polymerization initiator, may be mentioned persulfates (for example, potassium persulfate and ammonium persulfate). In addition, any of azo-based compounds (for example, 4,4'-azobis-4-cyanovaleric acid and salts thereof and 2,2'-azobis(2-amidinopropane) salts), peroxide compounds and azobisisobutyronitrile may be used.

Chain Transfer Agent:

In this step, any generally used chain transfer agent may be used for the purpose of controlling the molecular weight of the vinyl resin A. No particular limitation is imposed on the chain transfer agent, and as examples thereof, may be mentioned 2-chloroethanol, mercaptans such as octyl mercaptan, dodecyl mercaptan and t-dodecyl mercaptan and a styrene dimer.

If necessary, the toner particles according to the present invention may contain other internal additives such as a parting agent and a charge control agent. Such internal additives may be introduced into the toner particles by, for example, dissolving or dispersing the internal additives in the solution of the vinyl monomer for forming the vinyl resin in advance in this step.

Such internal additives may also be introduced into the toner particles as follows. A dispersion of internal additive particles composed only of the internal additives is prepared separately. Then the internal additive particles are aggregated in the toner particle forming step. However, it is preferable to use the method in which the internal additives are introduced in advance in this step.

The average particle diameter, i.e., the volume-based median diameter, of the fine resin particles A is preferably within the range of 80 to 1,000 nm.

The volume-based median diameter of the fine resin particles is a value measured using "Microtrac UPA-150" (manufactured by NIKKISO Co., Ltd.).

(b) Step of Preparing Water-Based Dispersion of Fine Colorant Particles:

This step is an optional step performed as needed when toner particles containing a colorant are desired. In this step, the colorant in a fine particle form is dispersed in a water-based medium to prepare a water-based dispersion of the fine colorant particles.

The water-based dispersion of the fine colorant particles is obtained by dispersing the colorant in a water-based medium containing a surfactant at a critical micelle concentration (CMC) or higher.

The colorant may be dispersed by utilizing mechanical energy, and no particular limitation is imposed on the disperser used. As preferred examples of the disperser, may be mentioned an ultrasonic disperser, a mechanical homogenizer, pressurizing dispersers such as a Manton-Gaulin homogenizer and a pressure-type homogenizer and medium-type dispersers such as a sand grinder, a Getzmann mill and a diamond fine mill.

The dispersed fine colorant particles have a voiume-based median diameter of preferably 10 to 300 nm, more preferably 100 to 200 nm, particularly preferably 100 to 150 nm.

The volume-based median diameter of the fine colorant particles is a value measured using an electrophoretic light-scattering photometer "ELS-800" (manufactured by Otsuka Electronics Co., Ltd.).

(c) Step of Preparing Water-Based Dispersion of Fine Crystalline Polyester Resin Particles:

In this step, the water-based dispersion of the fine crystalline polyester resin particles formed of the crystalline polyester resin is prepared.

The water-based dispersion of the fine crystalline polyester resin particles can be prepared by first synthesizing the crystalline polyester resin and dispersing the crystalline polyester resin in fine particle form in a water-based medium.

As examples of the method of dispersing the crystalline polyester resin in the water-based medium, may be mentioned a method including dissolving or dispersing the crystalline polyester resin in an organic solvent to prepare an oil phase solution, dispersing the oil phase solution in a water-based medium by, for example, phase inversion emulsification to form oil droplets with their particle diameter controlled to the desired value, and then removing the organic solvent.

The amount used of the water-based medium is preferably 50 to 2,000 parts by mass, more preferably 100 to 1,000 parts by mass per 100 parts by mass of the oil phase solution.

For the purpose of improving the dispersion stability of the oil droplets, a surfactant etc. may be added to the water-based medium. As examples of the surfactant, may be mentioned those exemplified in the above step.

The organic solvent used to prepare the oil phase solution is preferably a low-boiling point solvent with low solubility in water, from the viewpoint of ease of removal after formation of the oil droplets. As specific examples of such a solvent, may be mentioned methyl acetate, ethyl acetate, methyl ethyl ketone, methyl isobutyl ketone, toluene and xylene. These solvents may be used either singly or in any combination thereof. The amount used of the organic solvent is generally 1 to 300 parts by mass, preferably 1 to 100 parts by mass, more preferably 25 to 70 parts by mass per 100 parts by mass of the crystalline polyester resin.

Emulsification and dispersion of the oil phase solution may be performed by utilizing mechanical energy. No particular limitation is imposed on the disperser used for emulsification and dispersion. As examples of the disperser, may be mentioned a low-speed shear disperser, a high-speed shear disperser, a frictional disperser, a high-pressure jet disperser and an ultrasonic disperser. As specific examples of the disperser, may be mentioned a TK-type homomixer (manufactured by Tokushu Kika Kogyo Co., Ltd.).

The dispersion diameter of the oil droplets is preferably 60 to 1,000 nm, more preferably 80 to 500 nm.

The dispersion diameter of the oil droplets is a volume-based median diameter measured using a laser diffraction/scattering particle size distribution measurement device "LA-750" (manufactured by HORIBA Ltd.). The dispersion diameter of the oil droplets can be controlled by changing the mechanical energy during emulsification dispersion.

The average particle diameter, i.e., the volume-based median diameter, of the fine crystalline polyester resin particles is preferably within the range of 80 to 230 nm.

The volume-based median diameter of the fine crystalline polyester resin particles is a value measured using "Microtrac UPA-150" (manufactured by NIKKISO Co., Ltd.).

(d) Step of Preparing Water-Based Dispersion of Fine Resin Particles B:

In this step, the water-based dispersion of the fine resin particles B composed of the vinyl resin B is prepared.

To prepare the water-based dispersion of the fine resin particles B, the same method as the above-described method of obtaining the water-based dispersion of the fine resin particles A composed of the vinyl resin A can be used. As examples of the chain transfer agent and polymerization initiator usable in this step, may be mentioned those exemplified in the step of preparing the water-based dispersion of the fine resin particles A.

The average particle diameter, i.e., the volume-based median diameter, of the fine resin particles B is preferably within the range of 80 to 1,000 nm.

The volume-based median diameter of the fine resin particles B is a value measured using "Microtrac UPA-150" (manufactured by NIKKISO Co., Ltd.).

(e) Step of Forming Toner Particles:

In this step, the fine resin particles A, the fine crystalline polyester resin particles, the fine resin particles B and, if necessary, the fine colorant particles are aggregated and fusion-bonded by heat to form toner particles.

More specifically, an aggregating agent is added at a concentration equal to or higher than a critical aggregation concentration to a water-based dispersion containing the above-described fine particles dispersed in a water-based medium, and the mixture is heated to aggregate and fusion-bond the fine particles.

Preferably, the fusion bonding temperature is, for example, 65 to 97° C.

In this step, the fine crystalline polyester resin particles and the fine resin particles B individually form the respective domain phases, or pluralities of fused fine crystalline polyester resin particles and pluralities of fused fine resin particles B form the respective domain phases.

Aggregating Agent:

No particular limitation is imposed on the aggregating agent used in this step. An aggregating agent selected from metal salts such as salts of alkali metals and salts of alkaline-earth metals is preferably used. As examples of the metal salts, may be mentioned: salts of monovalent metals such as sodium, potassium and lithium; salts of divalent metals such as calcium, magnesium, manganese and copper; and salts of trivalent metals such as iron and aluminum. As specific examples of the metal salts, may be mentioned sodium chloride, potassium chloride, lithium chloride, calcium chloride, magnesium chloride, zinc chloride, copper sulfate, magnesium sulfate and manganese sulfate. Of these, salts of divalent metals are particularly preferably used because only a small amount of such a salt allows aggregation to proceed. These may be used either singly or in any combination thereof.

When the toner particle has a core-shell structure, the fine resin particles A, the fine crystalline polyester resin particles and the fine resin particles B are aggregated and fusion-bonded in this step to form core particles. Then fine resin particles for forming the shell layer are aggregated on and fusion-bonded to the core particles, whereby the core-shell structure can be formed.

(f) Aging Step:

This step is performed as needed. In the aging step, the toner particles obtained in the toner particle forming step are aged using thermal energy until the desired shape is obtained.

More specifically, the aging treatment is performed by heating and stirring the system containing the toner particles dispersed therein. The aging treatment is performed until the toner particles have the desired circularity while the heating temperature, stirring rate, heating time, etc. are controlled.

(g) Cooling Step:

In this step, the dispersion of the toner particles is subjected to cooling treatment. Preferably, the cooling treatment is performed under the condition of a cooling rate of 1 to 20° C./min. No particular limitation is imposed on the specific method for cooling treatment. As examples of the method, may be mentioned a cooling method in which a coolant is introduced from the outside of a reaction container and a cooling method in which cold water is directly introduced into the reaction system.

(h) Filtration and Washing Step:

In this step, the cooled dispersion of the toner particles is subjected to solid-liquid separation to separate the toner particles, and a toner cake obtained by solid-liquid separation (cake-like wet aggregates of the associated toner particles) is washed to remove adhering materials such as the surfactant and the aggregating agent.

No particular limitation is imposed on the solid-liquid separation method, and any of a centrifugation method, a vacuum filtration method using, for example, a suction funnel and a filtration method using, for example, a filter press may be used. Preferably, washing is performed with water until the electric conductivity of the filtrate becomes 10 μS/cm.

(i) Drying Step:

In this step, the toner cake subjected to washing treatment is dried. This step may be performed according to a general drying step used in a publicly known production process of toner particles.

As specific examples of the dryer used to dry the toner cake, may be mentioned a spray dryer, a vacuum freeze dryer and a vacuum dryer. Preferably, any of a stationary shelf dryer, a movable shelf dryer, a fluidized-bed dryer, a rotary dryer and a stirring dryer is used.

The content of water in the dried toner particles is preferably 5% by mass or lower, more preferably 2% by mass or lower. When the dried toner particles are aggregated together through weak interparticle attractive force, the aggregates may be subjected to pulverization treatment. The pulverizer used may be a mechanical pulverizer such as a jet mill, a Henschel mixer, a coffee mill or a food processor.

(j) Step of Adding External Additives:

This step is an optional step performed as needed when external additives are added to the toner particles.

The above toner particles can be used as a toner without adding any additive. However, the toner particles may be used with external additives such as a flowability improver and a cleaning aid added thereto, in order to improve flowability, charge property, cleanability, etc.

A combination of various external additives may be used.

The total amount of the external additives added is preferably 0.05 to 5 parts by mass, more preferably 0.1 to 3 parts by mass per 100 parts by mass of the toner particles.

The mixer used for the external additives may be a mechanical mixer such as a Henschel mixer or a coffee mill.

In the toner described above, the vinyl resin A serving as the main resin contains the crystalline polyester resin, and this basically provides low-temperature fixability. In addition, since the high-molecular weight vinyl resin B is contained as the domain phase, i.e., as a phase not compatible with the vinyl resin A, the following effect is obtained. During heat fixation, the vinyl resin A serving as the main resin and the crystalline polyester resin rapidly melt in a low-temperature state (for example, up to about 150° C.), and fixation on an image supporting medium is facilitated. In this case, it may be considered that, since the vinyl resin A and the crystalline polyester resin melt, the desired glossiness is achieved. In a high-temperature state (for example, about 150° C. or higher), the vinyl resin B starts melting and dissolves in the vinyl resin A serving as the main resin. The high-molecular weight vinyl resin B dissolved in the vinyl resin A can mitigate the reduction in viscosity of the vinyl resin A, so that an excessive increase in glossiness can be prevented. Therefore, stability of glossiness can be achieved for various types of paper.

The embodiment of the present invention has been specifically described. However, the embodiment of the present invention is not limited to the examples described above, and various modifications can be made thereto.

EXAMPLES

Specific Examples of the present invention will next be described, but the present invention is not limited thereto.

The volume-based median diameters of the fine resin particles, the fine colorant particles and the fine crystalline polyester resin particles were measured in the manner described above, and the molecular weights of the fine resin particles and the crystalline polyester resin were measured in the manner described above.

The glass transition points (Tg) of the fine resin particles and the toner and the melting points of the crystalline polyester resin and the fine resin particles were measured in the manners described above.

The average diameters of the domain phases were measured in the manner described above.

The carboxy group concentration or ester group concentration of each resin was computed in the manner described above.

Production Example 1 of Toner (1) Preparation of Water-Based Dispersion [A1] of Fine Resin Particles:

First Polymerization:

A 5 L reaction vessel equipped with a stirrer, a temperature sensor, a condenser tube and a nitrogen introduction device was charged with 8 g of sodium dodecyl sulfate and 3 L of ion exchanged water, and the temperature inside the vessel was increased to 80° C. while the mixture was stirred at a stirring rate of 230 rpm under nitrogen flow. After the temperature was increased, a solution prepared by dissolving 10 g of potassium persulfate in 200 g of ion exchanged water was added, and the temperature of the mixture was again increased to 80° C. A solution mixture of the following monomers was added dropwise over 1 hour, and the resultant mixture was heated to 80° C. and stirred for 2 hours to perform polymerization, whereby a dispersion (all of fine resin particles was prepared.

| | |
|---|---|
| Styrene | 480 g |
| n-Butyl acrylate | 250 g |
| Methacrylic acid | 68.0 g |

Second Polymerization:

A 5 L reaction vessel equipped with a stirrer, a temperature sensor, a condenser tube and a nitrogen introduction device was charged with a solution prepared by dissolving 7 g of sodium polyoxyethylene (2) dodecyl ether sulfate in 800 mL of ion exchanged water, and the solution was heated to 98° C. Then 260 g of the dispersion [a1] of the fine resin particles and a solution prepared by dissolving the following monomer solutions at 90° C. were added, and the components were stirred and dispersed for 1 hour using a mechanical disperser having a circulation path "CLEARMIX" (manufactured by M Technique Co., Ltd.) to prepare a dispersion containing emulsified particles (oil droplets).

| | |
|---|---|
| Styrene | 284 g |
| n-Butyl acrylate | 92 g |
| Methacrylic acid | 13 g |
| n-Octyl-3-mercaptopropionate | 1.5 g |
| Parting agent (behenic acid behenate, melting point: 73° C.) | 190 g |

Then an initiator solution prepared by dissolving 6 g of potassium persulfate in 200 mL of ion exchanged water was added to the obtained dispersion. The resultant system was heated at 84° C. and stirred for 1 hour to perform polymerization, and a dispersion [a2] of fine resin particles was thereby prepared.

Third Polymerization:

A solution prepared by dissolving 11 g of potassium persulfate in 400 mL of ion exchanged water was further added, and a monomer solution mixture of 400 g of styrene, 128 g of n-butyl acrylate, 28 g of methacrylic acid, 45 g of methyl methacrylate and 8 g of n-octyl-3-mercaptopropionate was added dropwise over 1 hour under a temperature condition of 82° C. After completion of dropwise addition, the mixture was heated and stirred for 2 hours to perform polymerization. Then the mixture was cooled to 28° C. to obtain a water-based dispersion [A1] of fine resin particles.

In the obtained water-based dispersion [A1] of the fine resin particles, the average diameter, i.e., the volume-based median diameter, of the fine resin particles was 220 nm, and their weight average molecular weight (Mw) was 25,000.

(2) Preparation of Water-Based Dispersion [Bk] of Fine Colorant Particles:

90 Parts by mass of sodium dodecyl sulfate was added to 1,600 parts by mass of ion exchanged water. 420 Parts by mass of carbon black (REGAL 330R, manufactured by Cabot Corporation) was gradually added to the obtained solution under stirring, and then the mixture was subjected to dispersion treatment using a stirrer "CLEARMIX" (manufactured by M Technique Co., Ltd.) to thereby prepare a water-based dispersion [Bk] of fine colorant particles.

The average particle diameter (the volume-based median diameter) of the fine colorant particles in the water-based dispersion [Bk] was 110 nm.

(3) Preparation of Water-Based Dispersion [1] of Fine Crystalline Polyester Resin Particles:

(3-1) Synthesis of Crystalline Polyester Resin:

A 5 L reaction vessel equipped with a stirrer, a temperature sensor, a condenser tube and a nitrogen introduction device was charged with 300 parts by mass of polyvalent carboxylic acid (sebacic acid, molecular weight: 202.25) and 170 parts by mass of polyhydric alcohol (1,6-hexanediol, molecular weight: 118.17). While the system was stirred, the temperature inside the vessel was increased to 190° C. over 1 hour. After it was confirmed that the system was uniformly stirred, $Ti(OBu)_4$ used as a catalyst was added in an amount of 0.003% by mass with respect to the amount charged of the polyvalent carboxyl acid. Then, while water generated was evaporated, the internal temperature was increased from 190° C. to 240° C. over 6 hours, and a dehydration condensation reaction was performed continuously under a temperature condition of 240° C. for 6 hours to perform polymerization, whereby a crystalline polyester resin [1] was obtained.

The melting point (Tm) of the obtained crystalline polyester resin [1] was 66.8° C., and its number average molecular weight (Mn) was 6,300.

(3-2) Preparation of Water-Based Dispersion of Fine Crystalline Polyester Resin Particles:

30 Parts by mass of the crystalline polyester resin [1] was melted, and the molten crystalline polyester resin [1] was transferred to an emulsification disperser "CAVITRON CD1010" (manufactured by EUROTEC Co., Ltd.) at a transfer rate of 100 parts by mass per minute. At the same time as the transfer of the molten crystalline polyester resin [1], diluted ammonia water having a concentration of 0.37% by mass and prepared by diluting 70 parts by mass of an ammonia water reagent with ion exchanged water in a water-based solvent tank was transferred to the emulsification disperser at a transfer rate of 0.1 L per minute while the diluted ammonia water was heated to 100° C. in a heat exchanger. The emulsification disperser was operated under the conditions of a rotor rotation speed of 60 Hz and a pressure of 5 kg/cm$^2$ to prepare a water-based dispersion [1] of fine crystalline polyester resin particles having a volume-based median diameter of 200 nm. The solid content in the water-based dispersion [1] was 30 parts by mass.

(4) Preparation of Water-Based Dispersion [B1] of Fine Resin Particles:

A 5 L reaction vessel equipped with a stirrer, a temperature sensor, a condenser tube and a nitrogen introduction device was charged with 8 g of sodium dodecyl sulfate and 3 L of ion exchanged water, and the temperature inside the vessel was increased to 80° C. while the mixture was stirred at a stirring rate of 230 rpm under nitrogen flow. After the temperature was increased, a solution prepared by dissolving 10 g of potassium persulfate in 200 g of ion exchanged water was added, and the temperature of the mixture was again increased to 80° C. A solution mixture of the following monomers was added dropwise over 1 hour, and the resultant mixture was heated to 80° C. and stirred for 2 hours to perform polymerization, whereby a water-based dispersion [B1] of fine resin particles was prepared. In the water-based dispersion [B1] of the fine resin particles, the average diameter, i.e., the volume-based median diameter, of the fine resin particles was 90 nm. The weight average molecular weight (Mw) thereof was 300,000, and the softening point (Tsp) thereof was 171° C.

| | |
|---|---|
| Itaconic acid | 48 g |
| n-Butyl acrylate | 192 g |
| Methyl methacrylate | 360 g |
| n-Octyl-3-mercaptopropionate | 0.5 g |

(5) Preparation of Water-Based Dispersion [S1] of Fine Resin Particles for Shell:

A 5 L reaction vessel equipped with a stirrer, a temperature sensor, a condenser tube and a nitrogen introduction device was charged with 8 g of sodium dodecyl sulfate and 3 L of ion exchanged water, and the temperature inside the vessel was increased to 80° C. while the mixture was stirred at a stirring rate of 230 rpm under nitrogen flow. After the temperature was increased, a solution prepared by dissolving 10 g of potassium persulfate in 200 g of ion exchanged water was added, and the temperature of the mixture was again increased to 80° C. A solution mixture of the following monomers was added dropwise over 1 hour, and the resultant mixture was heated to 80° C. and stirred for 2 hours to perform polymerization, whereby a water-based dispersion [S1] of fine resin particles for a shell was prepared. In the water-based dispersion [S1] of the fine resin particles, the average diameter, i.e., the volume-based median diameter, of the fine resin particles was 100 nm. The weight average molecular weight (Mw) thereof was 28,000, and the glass transition point (Tg) thereof was 60° C.

| | |
|---|---|
| Styrene | 480 g |
| n-Butyl acrylate | 250 g |
| Methacrylic acid | 68 g |
| n-Octyl-3-mercaptopropionate | 0.5 g |

(6) Production of Toner Particles [1]:

A separable flask equipped with a stirrer, a temperature sensor, a condenser tube and a nitrogen introduction device was charged with the water-based dispersion [A1] including 600 parts by mass of fine resin particles dispersed therein, the water-based dispersion [B1] including 60 parts by mass of fine resin particles dispersed therein, the water-based dispersion [1] including 90 parts by mass of fine crystalline polyester resin particles dispersed therein, 2,500 parts by mass of ion exchanged water, and 500 parts by mass of the water-based dispersion [Bk] of the fine colorant particles. After the temperature of the solution was adjusted to 25° C., an aqueous solution of sodium hydroxide with a concentration of 25% by mass was added to adjust the pH to 10.

Next, an aqueous solution prepared by dissolving 54.3 parts by mass of magnesium chloride hexahydrate in 54.3 parts by mass of ion exchanged water was added, and the temperature of the system was increased to 97° C. to initiate the aggregation reaction of the resin particles and the fine colorant particles.

After the start of the aggregation reaction, sampling was performed at regular intervals to measure the volume-based median diameter of core particles using a particle size distribution measuring device "Coulter Multisizer 3" (manufactured by Beckman Coulter, Inc.). Aggregation was continued under stirring until the volume-based median diameter became 6.3 μm.

Then an aqueous solution prepared by dissolving 11.5 parts by mass of sodium chloride in 46 parts by mass of ion exchanged water was added, and the water-based dispersion [S1] including 10 parts by mass of the fine resin particles for the shell dispersed therein was added to allow the fine resin particles for the shell to adhere to the surface of core particles.

Then an aqueous solution prepared by dissolving 11.5 parts by mass of sodium chloride in 46 parts by mass of ion exchanged water was added. The temperature of the system was adjusted to 95° C., and stirring was continued for 4 hours. When the circularity measured using a flow-type particle image analyzer "FPIA-2100" (manufactured by Sysmex) reached 0.946, the system was cooled to 30° C. under the condition of 6° C./min to terminate the reaction, whereby a dispersion of toner particles was obtained. The diameter of the cooled toner particles was 6.1 μm, and their circularity was 0.946.

The thus-obtained dispersion of the toner particles was subjected to solid-liquid separation using a basket-type centrifuge "MARK III TYPE 60×40" (manufactured by Matsumoto Machine Manufacturing Co., Ltd.) to form a wet cake. The wet cake was repeatedly washed and subjected to solid-liquid separation in the basket-type centrifuge until, the electric conductivity of the filtrate reached 15 μS/cm. Then air at a temperature of 40° C. and a humidity of 20% RH was blown using a "flash jet dryer" (manufactured by Seishin Enterprise Co., Ltd.) to dry the cake until the water content became 0.5% by mass, and the cake was cooled to 24° C. to thereby obtain toner particles [1].

1% By mass of hydrophobic silica particles and 1.2% by mass of hydrophobic titanium oxide were added to the obtained toner particles [1], and these particles were mixed using a Henschel mixer for 20 minutes under the condition of a peripheral speed of a rotary blade of 24 m/s and were caused to pass through a 400 mesh sieve to thereby add the external additives, whereby a toner [1] was obtained. For the obtained toner [1], cross sections of the toner particles stained with ruthenium (VIII) oxide were observed under a transmission electron microscope (TEM) using a measurement method known per se in the art, and a domain-matrix structure was found.

The glass transition point (Tg) of the obtained toner [1] was 37° C.

The addition of the external additives to the toner [1] did not change the shape and diameter of the toner particles.

Production Examples 2 to 15 of Toner

Toners [2] to [15] were obtained in the same manner as in Production Example 1 of the toner except that the types and amounts added of water-based dispersions were changed as shown in TABLE 1. For each of the obtained toners [2] to [15], cross sections of toner particles were observed under the transmission electron microscope (TEM) in the same manner as in the toner [1], and a domain-matrix structure was found.

The water-based dispersions [A2] and [A3] of fine resin particles in TABLE 1 were obtained by changing the composition of the monomers used in (1) preparation of water-based dispersion of fine resin particles in Production Example 1 of toner to a composition shown in TABLE 2.

The water-based dispersions [2] and [3] of fine crystalline polyester resin particles in TABLE 1 were obtained by changing the composition of the monomers used in (3-1) synthesis of crystalline polyester resin in Production Example 1 of toner to a composition shown in TABLE 3.

The water-based dispersions [B2] to [B5] of fine resin particles in TABLE 1 were obtained by changing the composition of the monomers used in (4) preparation of water-based dispersion of fine resin particles in Production Example 1 of toner to a composition shown in TABLE 4.

The water-based dispersion [S2] of fine resin particles for a shell in TABLE 1 was obtained by changing the composition of the monomers used in (5) preparation of water-based dispersion of fine resin particles for shell in Production Example 1 of toner to a composition shown in TABLE 5.

TABLE 1

| TONER No. | WATER-BASED DISPERSION OF FINE RESIN PARTICLES A | | | | WATER-BASED DISPERSION OF FINE RESIN PARTICLES B | | | | WATER-BASED DISPERSION OF FINE CRYSTALLINE POLYESTER RESIN PARTICLES | | | |
|---|---|---|---|---|---|---|---|---|---|---|---|---|
| | No. | Mw | CARBOXY GROUP CONCENTRATION α [mmol/g] | AMOUNT ADDED (IN TERMS OF SOLIDS/ PARTS BY MASS) | No. | Mw | CARBOXY GROUP CONCENTRATION β [mmol/g] | AMOUNT ADDED (IN TERMS OF SOLIDS/ PARTS BY MASS | No. | Tm (° C.) | ESTER GROUP CONCENTRATION γ [mmol/g] | AMOUNT ADDED (IN TERMS OF SOLIDS)/ PARTS BY MASS |
| 1 | A1 | 25,000 | 0.60 | 600 | B1 | 300,000 | 1.23 | 60 | 1 | 66.8 | 7.0 | 90 |
| 2 | A2 | 27,000 | 0.00 | 600 | B1 | 300,000 | 1.23 | 60 | 1 | 66.8 | 7.0 | 90 |
| 3 | A3 | 34,000 | 1.40 | 600 | B1 | 300,000 | 1.23 | 60 | 1 | 66.8 | 7.0 | 90 |
| 4 | A1 | 25,000 | 0.60 | 600 | B4 | 310,000 | 0.77 | 60 | 1 | 66.8 | 7.0 | 90 |
| 5 | A1 | 25,000 | 0.60 | 600 | B5 | 290,000 | 1.54 | 60 | 1 | 66.8 | 7.0 | 90 |
| 6 | A1 | 25,000 | 0.60 | 600 | B1 | 300,000 | 1.23 | 60 | 2 | 84.9 | 5.0 | 90 |
| 7 | A1 | 25,000 | 0.60 | 678 | B1 | 300,000 | 1.23 | 60 | 1 | 66.8 | 7.0 | 12 |
| 8 | A1 | 25,000 | 0.60 | 450 | B1 | 300,000 | 1.23 | 60 | 1 | 66.8 | 7.0 | 240 |
| 9 | A1 | 25,000 | 0.60 | 654 | B1 | 300,000 | 1.23 | 6 | 1 | 66.8 | 7.0 | 90 |
| 10 | A1 | 25,000 | 0.60 | 390 | B1 | 300,000 | 1.23 | 150 | 1 | 66.8 | 7.0 | 210 |
| 11 | A1 | 25,000 | 0.60 | 600 | B1 | 300,000 | 1.23 | 60 | 1 | 66.8 | 7.0 | 90 |
| 12 | A1 | 25,000 | 0.60 | 600 | B1 | 300,000 | 1.23 | 60 | 1 | 66.8 | 7.0 | 90 |
| 13 | A1 | 25,000 | 0.60 | 600 | B2 | 420,000 | 1.23 | 60 | 1 | 66.8 | 7.0 | 90 |
| 14 | A1 | 25,000 | 0.60 | 600 | B3 | 100,000 | 1.23 | 60 | 1 | 66.8 | 7.0 | 90 |
| 15 | A1 | 25,000 | 0.60 | 600 | B1 | 300,000 | 1.23 | 60 | 3 | 93.0 | 10.1 | 90 |

| TONER No. | WATER-BASED DISPERSION OF FINE RESIN PARTICLES FOR SHELL | | β~α | CONTENT OF CRYSTALLINE POLYESTER RESIN (% BY MASS) | CONTENT OF VINYL RESIN B (% BY MASS) |
|---|---|---|---|---|---|
| | No. | AMOUNT ADDED (IN TERMS OF SOLIDS/ PARTS BY MASS | | | |
| 1 | S1 | 10 | 0.6 | 15 | 10 |
| 2 | — | — | 1.2 | 15 | 10 |
| 3 | — | — | −0.2 | 15 | 10 |
| 4 | — | — | 0.2 | 15 | 10 |
| 5 | — | — | 0.9 | 15 | 10 |
| 6 | — | — | 0.8 | 15 | 10 |
| 7 | — | — | 0.8 | 2 | 10 |
| 8 | — | — | 0.6 | 40 | 10 |
| 9 | — | — | 0.6 | 15 | 1 |
| 10 | — | — | 0.6 | 35 | 25 |
| 11 | S1 | 10 | 0.6 | 15 | 10 |
| 12 | S2 | 10 | 0.6 | 15 | 10 |
| 13 | — | — | 0.6 | 15 | 10 |
| 14 | — | — | 0.6 | 15 | 10 |
| 15 | — | — | 0.6 | 15 | 10 |

TABLE 2

| | COMPOSITION OF RESIN MOLE RATIO | | | |
|---|---|---|---|---|
| | STRENE (MOLECULAR WEIGHT: 104.15) | BUTYL ACRYLATE (MOLECULAR WEIGHT: 128.17) | METHACRYLATE ACID (MOLECULAR WEIGHT: 88.09) | METHYL METHACRYLATE (MOLECULAR WEIGHT: 100.10) |
| WATER-BASED DISPERSION OF FINE RESIN PARTICLES [A1] | 10.8 | 3.1 | 1.0 | 0.6 |
| WATER-BASED DISPERSION OF FINE RESIN PARTICLES [A2] | 10.3 | 2.9 | 0.0 | 0.6 |
| WATER-BASED DISPERSION OF FINE RESIN PARTICLES [A3] | 4.3 | 1.2 | 1.0 | 0.3 |

| | CARBOXY GROUP CONCENTRATION α [mmol/g] | Tg (° C.) | Mw |
|---|---|---|---|
| | 0.60 | 45 | 25,000 |
| | 0.00 | 51 | 27,000 |
| | 1.40 | 32 | 34,000 |

TABLE 3

| | COMPOSITION OF RESIN | | | | | |
|---|---|---|---|---|---|---|
| | POLYVALENT CARBOXYLIC ACID | | | POLYHYDRIC ALCOHOL | | |
| | TYPE | MOLECLUAR WEIGHT | PARTS BY MASS | TYPE | MOLECLUAR WEIGHT | PARTS BY MASS |
| WATER-BASED DISPERSION OF CRYSTALLINE POLYESTER RESIN [1] | SEBACIC ACID | 202.3 | 300.0 | 1,6-HEXANEDIOL | 118.2 | 170.0 |
| WATER-BASED DISPERSION OF CRYSTALLINE POLYESTER RESIN [2] | DODECANEDIOIC ACID | 230.3 | 341.6 | 1,12-DODECANDEDIOL | 202.3 | 291.1 |
| WATER-BASED DISPERSION OF CRYSTALLINE POLYESTER RESIN [3]※ | FUMARIC ACID | 116.1 | 172.2 | 1,6-HEXANEDIOL | 118.2 | 170.0 |

| | ESTER GROUP CONCENTRATION γ [mmol/g] | Tm (° C.) | Mn |
|---|---|---|---|
| WATER-BASED DISPERSION OF CRYSTALLINE POLYESTER RESIN [1] | 7.0 | 66.8 | 6300 |
| WATER-BASED DISPERSION OF CRYSTALLINE POLYESTER RESIN [2] | 5.0 | 84.9 | 7000 |
| WATER-BASED DISPERSION OF CRYSTALLINE POLYESTER RESIN [3] | 10.1 | 93.0 | 7000 |

※Water-based dispersion [3] of crystalline polyester resin contains 5 parts by mass of trimellitic acid.

TABLE 4

| | COMPOSITION OF RESIN MOLE RATIO | | | CARBOXY GROUP | | | AMOUNT |
|---|---|---|---|---|---|---|---|
| | ITACONIC ACID (MOLECULAR WEIGHT:130.10) | BUTYL ACRYLATE (MOLECULAR WEIGHT:128.17) | METHYL METHACRYLATE (MOLECULAR WEIGHT:100.10) | CONCEN-TRATION β [mmol/g] | Tsp (° C.) | Mw | OF n-OCTYL, MER-CAPTAN |
| WATER-BASED DISPERSION OF FINE RESIN PARTICLES [B1] | 0.07 | 0.27 | 0.66 | 1.2 | 171 | 300,000 | 0.5 |
| WATER-BASED DISPERSION OF FINE RESIN PARTICLES [B2] | 0.07 | 0.27 | 0.66 | 1.2 | 183 | 420,000 | 0.0 |

TABLE 4-continued

| | COMPOSITION OF RESIN MOLE RATIO | | | CARBOXY GROUP | | | AMOUNT |
|---|---|---|---|---|---|---|---|
| | ITACONIC ACID (MOLECULAR WEIGHT:130.10) | BUTYL ACRYLATE (MOLECULAR WEIGHT:128.17) | METHYL METHACRYLATE (MOLECULAR WEIGHT:100.10) | CONCEN-TRATION β [mmol/g] | Tsp (° C.) | Mw | OF n-OCTYL, MER-CAPTAN |
| WATER-BASED DISPERSION OF FINE RESIN PARTICLES [B3] | 0.07 | 0.27 | 0.66 | 1.2 | 85 | 100,000 | 5.0 |
| WATER-BASED DISPERSION OF FINE RESIN PARTICLES [B4] | 0.04 | 0.21 | 0.75 | 0.8 | 160 | 310,000 | 0.5 |
| WATER-BASED DISPERSION OF FINE RESIN PARTICLES [B5] | 0.08 | 0.17 | 0.75 | 1.5 | 192 | 290,000 | 0.5 |

TABLE 5

| | COMPOSTION OF RESIN | | | | | | | |
|---|---|---|---|---|---|---|---|---|
| | TYPE | PARTS BY MASS | TYPE | PARTS BY MASS | TYPE | PARTS BY MASS | Tg (° C.) | Mw |
| WATER-BASED DISPERSION OF FINE RESIN PARTICLES FOR SHELL [S1] | STYRENE | 480 | BUTYL ACRYLATE | 250 | METHACRYLIC ACID | 68 | 60 | 28000 |
| WATER-BASED DISPERSION OF FINE RESIN PARTICLES FOR SHELL [S2] | STYRENE | 530 | BUTYL ACRYLATE | 200 | METHACRYLIC ACID | 68 | 65 | 29000 |

Production Examples 1 to 15 of Developer

Developers [1] to [15] were produced by adding a ferrite carrier having a volume-based median diameter of 60 μm and coated with a silicone resin to each of the toners [1] to [15] such that the concentration of the toner was 6% by mass and then mixing them using a V-type mixer.

Examples 1 to 12 and Comparative Examples 1 to 3

(1) Evaluation of Low-Temperature Fixability:

A fixation experiment was performed using a copier "bizhub PRO C6550" (manufactured by Konica Minolta Business Technologies, Inc.) including a fixing unit modified such that the surface temperature of a heating roller (fixation temperature) could be changed within the range of 120 to 200° C. In the fixation experiment, a solid image with a toner adhesion amount of 8 mg/cm$^2$ was fixed on an A4 high-quality paper sheet in a room temperature-room humidity environment (temperature: 20° C., humidity: 50% RH). The fixation experiment was repeated at different fixation temperature settings, i.e., the fixation temperature was increased from 120° C. to 200° C. in steps of 5° C.

In the results of the fixation experiment in which no image contamination due to cold offset was visually observed, the lowest one of the fixation temperatures was evaluated as the lowest fixation temperature. The results are shown in TABLE 6. A developer having a lowest fixation temperature of 140° C. or lower was judged as pass.

(2) Evaluation of Stability of Glossiness:

With the copier "bizhub PRO C6550" (manufactured by Konica Minolta Business Technologies, Inc.), solid images with a toner adhesion amount of 4 mg/cm$^2$ were formed on A4 high-gloss paper sheets (POD gloss coat (basis weight: 128 g/m$^2$), manufactured by Oji Paper Co., Ltd.) and A4 low-gloss paper sheets (POD matte coat (basis weight: 128 g/m$^2$), manufactured by Oji Paper Co., Ltd.) in a room temperature-room humidity environment (temperature: 20° C., humidity: 50% RH).

The glossiness of each solid image was measured using "Gardner micro-gloss 75° gloss meter" (manufactured by BYK-Gardner) and evaluated according to the following evaluation criteria. The results are shown in TABLE 6. A developer with a rating equal to or higher than B was judged as pass.

Evaluation Criteria

A: The difference in glossiness with the white background was 10% or less.

B: The difference in glossiness with the white background was more than 10% and 20% or less.

C: The difference in glossiness with the white background was more than 20%.

TABLE 6

| | | EVALUATION RESULTS | | |
|---|---|---|---|---|
| | | | STABILITY OF GLOSSINESS | |
| | TONER No. | LOW-TEMPERATURE FIXABILITY (° C.) | HIGH-GLOSS PAPER | LOW-GLOSS PAPER |
| EXAMPLE 1 | 1 | 135 | A | A |
| EXAMPLE 2 | 2 | 140 | B | A |
| EXAMPLE 3 | 3 | 132 | A | B |
| EXAMPLE 4 | 4 | 132 | A | B |
| EXAMPLE 5 | 5 | 139 | B | A |
| EXAMPLE 6 | 6 | 138 | B | A |

TABLE 6-continued

| | | EVALUATION RESULTS | | |
|---|---|---|---|---|
| | | | STABILITY OF GLOSSINESS | |
| | TONER No. | LOW-TEMPERATURE FIXABILITY (° C.) | HIGH-GLOSS PAPER | LOW-GLOSS PAPER |
| EXAMPLE 7 | 7 | 139 | B | A |
| EXAMPLE 8 | 8 | 133 | A | B |
| EXAMPLE 9 | 9 | 132 | A | B |
| EXAMPLE 10 | 10 | 140 | B | A |
| EXAMPLE 11 | 11 | 138 | B | A |
| EXAMPLE 12 | 12 | 137 | A | B |
| COMPARATIVE EXAMPLE 1 | 13 | 143 | C | A |
| COMPARATIVE EXAMPLE 2 | 14 | 134 | A | C |
| COMPARATIVE EXAMPLE 3 | 15 | 145 | C | A |

REFERENCE SIGNS LIST

10 Toner particle
11 Matrix phase
12 Domain phase
12*a* First domain phase
12*b* Second domain phase
20 Core particle
30 Shell layer

The invention claimed is:

1. A toner for electrostatic image development comprising toner particles, wherein the toner particles have a domain-matrix structure in which a domain phase comprising crystalline polyester resin having a melting point of 40 to 90° C. and domain phase comprising a vinyl resin resin B having a weight average molecular weight of 250,000 to 400,000 are dispersed in a matrix phase comprising a vinyl resin A having a weight average molecular weight of 10,000 to 50,000.

2. The toner for electrostatic image development according to claim 1, wherein a carboxy group concentration $\alpha$ in the vinyl resin A and a carboxy group concentration $\beta$ in the vinyl resin B satisfy the relation (1): $\beta-\alpha\geq0.5$,and the carboxy group concentration $\beta$ in the vinyl resin B is 0.7 to 1.5 mmol/g.

3. The toner for electrostatic image development according to claim 1, wherein an ester group concentration in the crystalline polyester resin is 0.1 to 7.0 mmol/g.

4. The toner for electrostatic image development according to claim 1, wherein a content of the vinyl resin B in the resins constituting the toner particles is 2 to 20% by mass.

5. The toner for electrostatic image development according to claim 1, wherein the toner particle has a core particle and a shell layer coating a surface of the core particle to form a core-shell structure, the core particle has the domain-matrix structure, and the shell layer comprises an amorphous resin.

6. The toner for electrostatic image development according to claim 1, wherein in the toner particles having the domain-matrix structure, an average diameter of the domain phase formed of the crystalline polyester resin is 50 to 2,000 nm, and an average diameter of the domain phase formed of the vinyl resin B is 50 to 1,000 nm.

7. The toner for electrostatic image development according to claim 1, wherein a content of the crystalline polyester resin in the resins constituting the toner particles is 5 to 30% by mass.

8. The toner for electrostatic image development according to claim 1, wherein the melting point of the crystalline polyester resin is 55 to 85° C.

9. The toner for electrostatic image development according to claim 1, wherein a weight average molecular weight (Mw) and a number average molecular weight (Mn) of the crystalline polyester resin measured by gel permeation chromatography (GPC) are 2,000 to 30,000 and 2,000 to 25,000, respectively.

10. The toner for electrostatic image development according to claim 3, wherein the ester group concentration in the crystalline polyester resin is 0.4 to 0.7 mmol/q.

11. The toner for electrostatic image development according to claim 2, wherein the carboxy group concentration $\beta$ in the vinyl resin B is 0.1 to 1.4 mmol/g.

12. The toner for electrostatic image development according to claim 2, wherein the carboxy group concentration $\alpha$ in the vinyl resin A is 0.2 to 1.0 mmol/g.

* * * * *